US006111495A

United States Patent [19]

Garside

[11] Patent Number: 6,111,495

[45] Date of Patent: Aug. 29, 2000

[54] ALERT DEVICE

[76] Inventor: Melissa F. Garside, 32 W. 370 Army Trail Rd., Wayne, Ill. 60184

[21] Appl. No.: 09/256,247

[22] Filed: Feb. 23, 1999

[51] Int. Cl.[7] ..... G08B 1/00

[52] U.S. Cl. ..... 340/309.15; 340/309.4; 340/457.4

[58] Field of Search ..... 340/309.15, 309.3, 340/309.4, 460, 457, 457.4, 692, 693.5; 368/10, 41, 63, 274, 1; 248/214

[56] References Cited

U.S. PATENT DOCUMENTS

| | | | |
|---|---|---|---|
| 3,919,834 | 11/1975 | Murakami et al. | 368/63 |
| 4,286,331 | 8/1981 | Anderson et al. | 340/541 |
| 4,302,752 | 11/1981 | Weitzler | 340/309.15 |
| 4,563,780 | 1/1986 | Pollack | 4/668 |
| 4,757,305 | 7/1988 | Peso | 340/624 |
| 4,867,189 | 9/1989 | Moineau | 137/1 |
| 4,936,508 | 6/1990 | Ingalz | 340/610 |
| 4,987,403 | 1/1991 | Apfel | 340/309.15 |
| 5,014,947 | 5/1991 | Wang | 248/214 |
| 5,149,942 | 9/1992 | Garrett | 219/219 |
| 5,555,536 | 9/1996 | Rolf et al. | 340/307.15 |
| 5,570,325 | 10/1996 | Arpardi | 368/10 |
| 5,648,760 | 7/1997 | Kumar | 340/309.15 |
| 5,708,627 | 1/1998 | Gormley | 368/10 |
| 5,714,925 | 2/1998 | Lee et al. | 340/309.15 |

*Primary Examiner*—Brent A. Swarthout
*Assistant Examiner*—Van T. Trieu
*Attorney, Agent, or Firm*—Thomas R. Vigil

[57] ABSTRACT

The alert device comprises: a housing mounting therein electrical circuitry including: a timer circuit; a voice recording and playback circuit coupled to the timer circuit; a microphone coupled to the voice recording and playback circuit for inputting messages into the voice recording and playback circuit; a speaker coupled to the voice recording and playback circuit for outputting a message from the voice recording and playback circuit after a predetermined time period preset by the user; and, a power source coupled to the timer circuit and to the voice recording and playback circuit; first switching structure mounted on or in the housing for controlling the voice recording and playback circuit for the recording of messages; and, second switching structure mounted on or in the housing and coupled to the timer circuit for controlling the setting of the timer circuit.

8 Claims, 2 Drawing Sheets

ALERT DEVICE

BACKGROUND OF THE INVENTION

1. Field of the Invention

The present invention relates to an alert device for alerting a user of the expiration of a time period set by the user, the alert being an audio message pre-recorded by the user or another and is particularly useful in alerting a user in a shower when a preset showering time has elapsed.

2. Description of The Prior Art

Heretofore a number of different alarm or alert devices have been proposed. Examples of some of these devices are disclosed in the following U.S. Patents.

| U.S. Pat. No. | PATENTEE |
|---|---|
| 4,286,331 | Anderson et al. |
| 4,563,780 | Pollack |
| 4,757,305 | Peso |
| 4,867,182 | Moineau |
| 4,936,508 | Ingalz |
| 5,149,942 | Garrett |
| 5,570,325 | Arpadi |
| 5,708,627 | Gormley |

The Anderson et al. U.S. Pat. No. 4,286,331 is directed to a monitoring system which times the time someone is in a bathroom and the time when appliances in the bathroom are used. This patent does not alert a person with a pre-recorded message when a certain time period has expired.

The Pollack U.S. Pat. No. 4,563,780 is directed to an automatic computer controlled bathroom including a shower, bathtub, sink and toilet which all can be electronically controlled. The system disclosed in this patent can open the water supply at a predetermined time in the morning for filling a bathtub.

The Peso U.S. Pat. No. 4,757,305 teaches a float switch and sound alarm for indicating when the water level in a tub exceeds a certain level.

The Moineau U.S. Pat. No. 4,867,189 teaches a water flow shower control valve by which the time a bather can use a shower is controlled by a pair of timers in a solenoid operated valve.

The Ingalz U.S. Pat. No. 4,936,508 teaches an audible alarm which is sounded after a predetermined amount of water has been passed through a shower head.

The Garrett U.S. Pat. No. 5,149,942 teaches a heater for a mirror with a sound producing unit for controlling the heating time.

The Arpadi U.S. Pat. No. 5,570,325 discloses a toothbrush timer device which only has visual alerts and does not have a pre-recorded message.

The Gormley U.S. Pat. No. 5,708,627 teaches an electronic device that stores recorded messages and correlates each message with the time and day it was received.

SUMMARY OF THE INVENTION

According to the present invention there is provided an alert device comprising: a housing mounting therein electrical circuitry including: a timer circuit; a voice recording and playback circuit coupled to the timer circuit; a microphone coupled to the voice recording and playback circuit for inputting messages into the voice recording and playback circuit; a speaker coupled to the voice recording and playback circuit for outputting a message from the voice recording and playback circuit after a predetermined time period preset by the user; and, a power source coupled to the timer circuit and to the voice recording and playback circuit; first switching structure mounted on or in the housing for controlling the voice recording and playback circuit for the recording of messages; and, second switching structure mounted on or in the housing and coupled to the timer circuit for controlling the setting of the timer circuit

DESCRIPTION OF THE PREFERRED EMBODIMENT(S)

Figure 1:
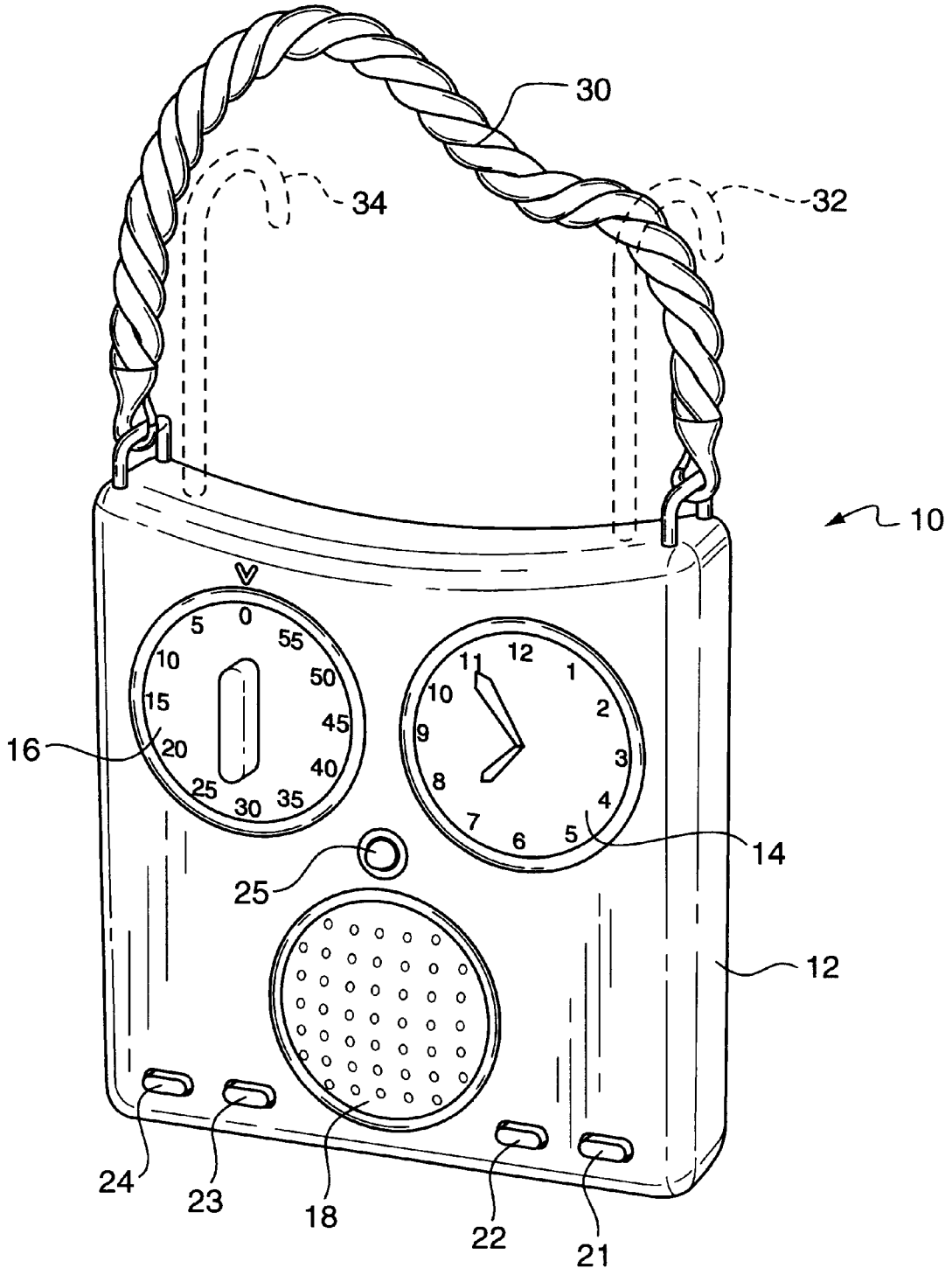
FIG. 1 is a front perspective view of one embodiment of the alert device of the present invention.
Figure 3:
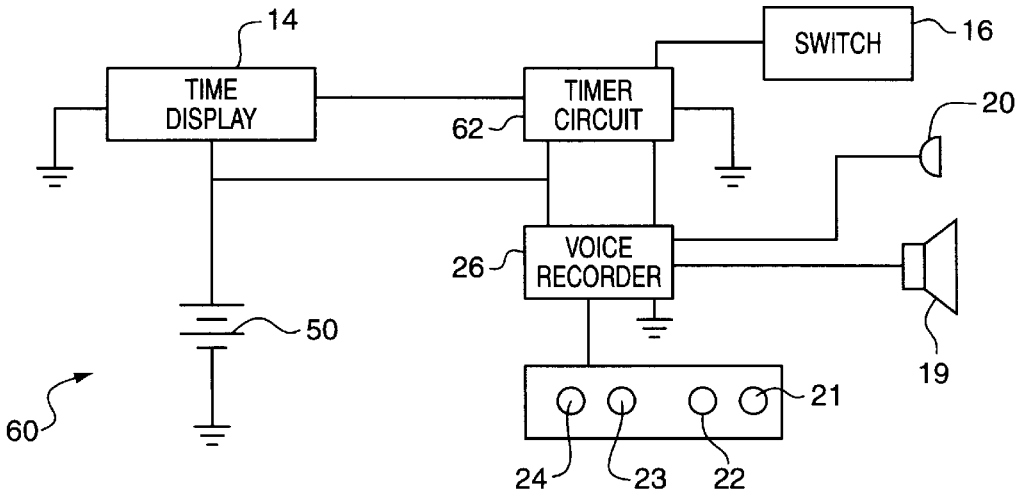
FIG. 3 is a block schematic circuit diagram of the circuitry of the alert device of the present invention.

Referring to the drawings in greater detail, there is illustrated in FIG. 1 one preferred embodiment of the alert device 10 of the present invention. As shown, the device 10 includes a housing or case 12, a time indicating device 14, shown as an analog clock 14, a time setting switch 16, a perforated cover/wall 18 for a speaker 19 (FIG. 3) and/or a microphone 20 (FIG. 3) of the device 10, as shown in FIG. 3, and pushbuttons 21, 22, 23 and 24 for setting the device 10.

Pushbutton 21 is pressed to turn on a voice recording/playback circuit chip 26 (shown in FIG. 3) of the device 10. A red indicating light 25 will be turned on to indicate that the recording circuit 26 is on. Then, by pressing pushbutton 22 one can record a message such as "Rinse Off Now". Then, by pressing pushbutton 23 one can record a second message, e.g. "Hurry—Up!" Finally, one can press the third pushbutton 24 for recording a third message such as "You Are Beautiful—Your Time Is Up".

While the device 10 can be merely set on a planar surface, e.g., a bathroom counter top, various structures can be used for mounting the alert device 10 in an area where it is going to be used, such as, for example, in a bathroom when one is taking a shower. For this purpose, a loop of rope, string or cable 30 can extend across the top of the housing 12, as shown in FIG. 1.

As shown in phantom, in addition to or in place of the rope 30, one can provide two hooks 32 and 34, as shown, for mounting the device on a shower rod or other rod (not shown).

Figure 2:
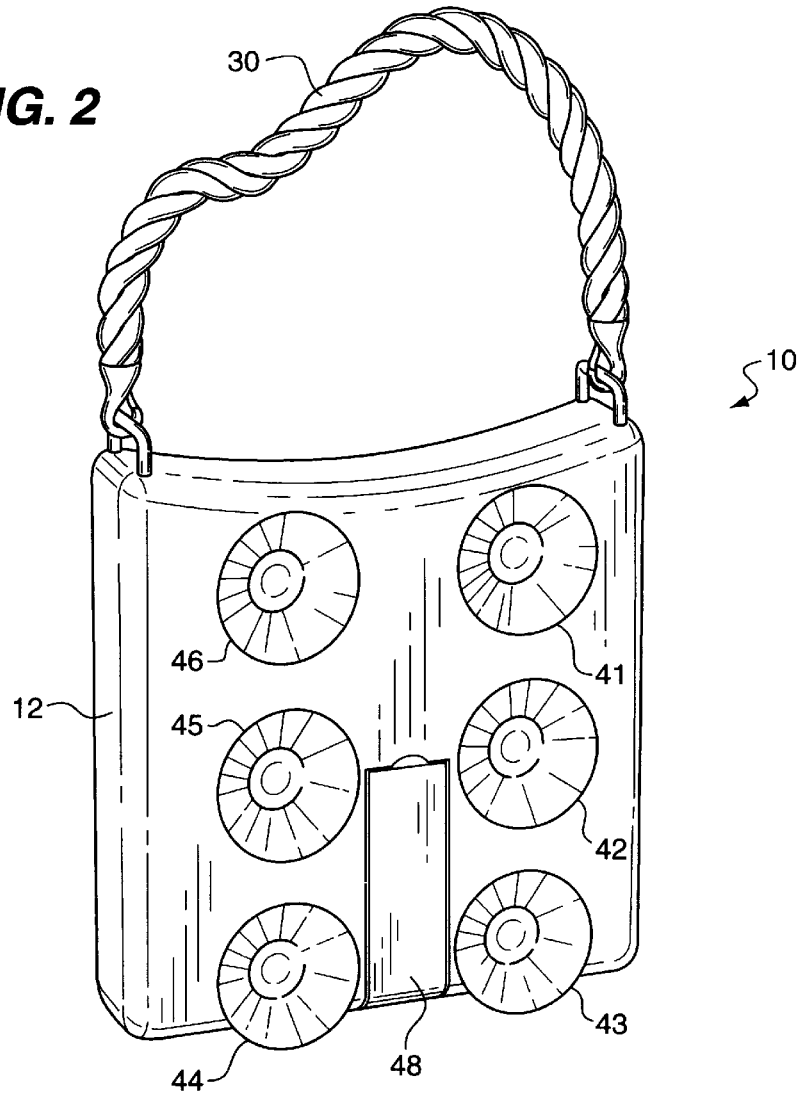
FIG. 2 is a back perspective view of the alert device of the present invention shown in FIG. 1 and shows suction cups holding the alert device to a wall surface.

Finally, as shown in FIG. 2, one can mount suction cups 41–46 on the back of the housing 12 for mounting the housing 12 on a wall surface in a bathroom or in a shower.

As shown in FIG. 2, a removable door 48 is provided for obtaining access to the interior of the device 10 for inserting batteries 50, shown in FIG. 3.

While a time setting switch 16 is shown in FIG. 1 as an analog switch, of the type used with an oven, it is to be understood that a digital type switch and time display with pushbuttons could be utilized in place thereof, like the switches and displays used in clock alarm radios.

Also, while a conventional clock 14 is shown in FIG. 1, it is to be understood that the clock 14 can be a digital clock and pushbuttons can be provided for setting the same, as opposed to physically moving the hands on the clock 14 shown in FIG. 1.

Referring now to FIG. 3, there is shown therein circuitry 60 for the alert device 10 of the present invention. The circuitry 60 includes a DC power source/batteries 50 comprising one or more batteries 50, as shown. Connected to the power source 50 is a timer circuit 62 which in turn is connected to the clock or time display 14. The timer circuit 62 is also connected to the voice recording/playback circuit chip 26 which can be of the type disclosed in U.S. Pat. Nos. 4,989,179, 5,126,967 and 5,164,915.

The voice recording/playback circuit 26 is coupled to the pushbuttons 21–24, to an input microphone 20 and to an output speaker 19 positioned in the housing 12 behind the perforated wall 18 can be incorporated into one speaker/microphone unit, if desired.

In the use of the alert device 10, one will press the "Record" button 21 and then start presenting messages, such as by pressing pushbutton 22 to record the first message, pressing pushbutton 23 to record a second message and pressing pushbutton 24 to record a third message. Then, at the time set by the time setting switch 16, the playback circuit 26 is activated to send a pre-recorded message to the speaker 19. It will be understood that the voice recording/playback circuit 26 and the timer circuit 62 are constructed, arranged and programmed to provide a series, e.g., three (3), time spaced messages, such as described above.

From the foregoing description, it will be understood that the alert device 10 can be simply supported on a planar surface, such as a bathroom counter top or mounted or suspended by a rope 30, a hook 32 or 34, or secured to a wall surface by suction cups 41–46.

Also, it will be understood that, while the alert device 10 has been described for particular use in a shower, it can be used in other rooms of the home, or even outside, for letting someone know when it's time to stop washing the car or raking the leaves to get ready for a dinner or other appointment.

Thus, while alert devices, such as radio alarms set to wake a person up at a certain time and provide a beeping sound or talk or music, the alert device 10 of the present invention is unique by providing for a pre-recorded message, recorded by the user, for subsequently alerting the user after a predetermined time period when a certain time period has expired, such as when someone is taking a shower and needs to be ready for an appointment.

From the foregoing description, it will be understood that the alert device 10 of the present invention has a number of advantages, some of which have been described above and others of which are inherent in the invention. Accordingly, the scope of the invention is only to be limited as necessitated by the accompanying claims.

I claim:

1. An alert device for use by children and adults comprising:

a housing electrical circuitry mounted in said housing;

said electrical circuitry including:

a timer circuit including a rotatable, finger and thumb engageable, switch arm on a dial positioned on a front face of said housing;

a voice recording circuit coupled to said timer circuit;

a voice playback circuit coupled to said timer circuit;

a microphone coupled to said voice recording circuit for inputting messages into said voice recording circuit;

a speaker coupled to said voice playback circuit for outputting a message from said voice playback circuit after a predetermined time period preset by the user by rotating said switch arm to a time number on said dial;

a self contained DC power source in said housing and coupled to said timer circuit, to said voice recording circuit and to said voice playback circuit;

a first push button switch mounted on or in said housing and coupled to said voice recording circuit for controlling said voice recording circuit for the recording of messages;

a second push button switch mounted on or in said housing and coupled to said voice playback circuit for playing back the message recorded; and, mounting means for vertical mounting of said housing.

2. The alert device of claim 1 wherein said DC power source comprises at least one battery.

3. The alert device of claim 1 including an ON/OFF switch.

4. The alert device of claim 1 wherein three message recording switches are provided so that time spaced messages can be played back.

5. The alert device of claim 1 wherein said speaker and said microphone are incorporated into one unit.

6. The alert device of claim 1 wherein said mounting means comprises a rope or cable fixed at each end to said housing.

7. The alert device of claim 1 wherein said mounting means comprises at least one suction cups on said housing.

8. The alert device of claim 1 wherein said mounting means comprises at least one hook extending from said housing for suspending said alert device from a rod.

* * * * *